US005984092A

United States Patent [19]

Heard-Willmon

[11] Patent Number: 5,984,092

[45] Date of Patent: Nov. 16, 1999

[54] FOLDING ORGANIZER

[76] Inventor: C. Donise Heard-Willmon, P.O. Box 456, Belen, N. Mex. 87002

[21] Appl. No.: 09/014,872

[22] Filed: Jan. 28, 1998

Related U.S. Application Data

[60] Provisional application No. 60/036,513, Jan. 28, 1997.

[51] Int. Cl.[6] ..... B65D 69/00

[52] U.S. Cl. ..... 206/233; 206/232; 383/38; 383/119

[58] Field of Search ..... 206/233, 214, 206/38, 224, 371, 232, 349, 425, 445, 820; 383/38–40, 119; 150/112, 130

[56] References Cited

U.S. PATENT DOCUMENTS

| | | | |
|---|---|---|---|
| D. 268,224 | 3/1983 | Huntebrinker et al. . | |
| 860,264 | 7/1907 | Stevens . | |
| 1,085,950 | 2/1914 | Steinthal . | |
| 1,128,542 | 2/1915 | Steinthal . | |
| 2,468,973 | 5/1949 | Hambrock . | |
| 2,754,867 | 7/1956 | Langer . | |
| 3,334,677 | 8/1967 | Toomey . | |
| 3,923,153 | 12/1975 | Valls Rius . | |
| 4,301,916 | 11/1981 | Handelman | 383/39 |
| 4,314,635 | 2/1982 | Fraser et al. | 206/425 |
| 4,502,596 | 3/1985 | Saetre et al. | 206/820 |
| 4,524,852 | 6/1985 | Hess . | |
| 4,685,570 | 8/1987 | Medow | 383/40 |
| 4,738,547 | 4/1988 | Brown . | |
| 4,762,225 | 8/1988 | Hankel | 206/445 |
| 4,901,899 | 2/1990 | Barrett . | |
| 4,949,843 | 8/1990 | Stokes | 383/38 |
| 5,002,401 | 3/1991 | Blackman . | |
| 5,020,673 | 6/1991 | Adams . | |
| 5,139,143 | 8/1992 | Pond | 206/233 |
| 5,547,077 | 8/1996 | Wang | 383/39 |

*Primary Examiner*—B. Dayoan
*Assistant Examiner*—Luan K. Bui
*Attorney, Agent, or Firm*—Rod D. Baker

[57] ABSTRACT

An organizer apparatus for carrying numerous samples or other items. Organizer has a single flexible sheet which is divided into six or more panels by parallel folds or plications. The panels have inner faces upon which pockets, loops and the like may be provided for holding and displaying items. The organizer may be folded in a pattern which places the panels in a certain parallel position so that the organizer is compact for carriage or storage. When the organizer is collapsed into the compact position, specially located fasteners hold the organizer in this closed position in a manner which secures the contained items. The specially located fasteners, combined with the particular folding pattern, permit the organizer to be unfolded and used in a manner which promotes an orderly, pleasant presentation of the contained items to the user or potential customer. A mode of construction is disclosed which permits the organizer to hold bulkier, non-planar items, without impeding the integrity or compactness of the apparatus. Certain specialized cases are disclosed which can be used to carry the organizer.

17 Claims, 6 Drawing Sheets

FOLDING ORGANIZER

CROSS-REFERENCE TO RELATED APPLICATIONS

This application claims the benefit of the filing of U.S. Provisional patent application Ser. No. 60/036,513, entitled "Ultimate Organizer," filed on Jan. 28, 1997, and the specification thereof is incorporated herein by reference.

BACKGROUND OF THE INVENTION

1. Field of the Invention (Technical Field)

The present invention relates generally to cases and pocketbooks, particularly pocketed cases for holding several items in an organized manner, and more particularly to an organizer apparatus which holds numerous items in an easily organized manner for retrieval or display, and which is foldable for compactness.

2. Background Art

Previous efforts abound to provide an item organizer that is conveniently sized, and yet permits a vast array of items to be neatly organized for carrying and retrieval. An older example of an effort in this regard is U.S. Pat. No. 860,264 to Stevens, which teaches the construction of a case for holding many eyeglass lenses, and which rolls up for compact storage. A number of early devices in the art of pocketbooks and portfolios were directed to providing a way to display samples, for example, for use in sales presentations. U.S. Pat. No. 1,085,950 to Steinthal, entitled "Portfolio for Displaying Samples," and U.S. Pat. No. 1,128,542 to Steinthal, entitled "Case for Displaying Samples," disclose types of sample cases which can be collapsed to smaller sizes for carrying. Frequently, folders and portfolios which may hold several items are folded to reduce their size, as seen for example in the older U.S. Pat. No. 2,468,973 to Hambrock, entitled "Multisectioned Folder," U.S. Pat. No. 2,754,867 to Langer, entitled "Hosiery Purse," and U.S. Pat. No. 3,334,677 to Toomey, entitled "Wallet." While all these devices include either multiple pockets and/or foldable multi-panel construction, they all are either too complicated for convenient use, especially for display, or sacrifice security of contents for the sake of simplicity. Also, many previous foldable portfolios have been unable to hold thicker, substantially non-planar items.

The need for simple yet effective organizer portfolios has continued to the present, and efforts to meet the need are manifest by the more recent U.S. Pat. No. 3,923,153 to Valls Rius, entitled "Display Device for Displaying Articles in a Bulged Condition," U.S. Pat. No. 4,524,852 to Hess, entitled "Plastic Siding Sample Case," and U.S. Pat. No. 4,738,547 to Brown, entitled "Carrying Bag." Even more recently, U.S. Pat. No. 4,901,899 was issued to Barrett, U.S. Pat. No. 5,002,401 was issued to Blackman, and U.S. Pat. No. 5,020,673 was issued to Adams. The more modem cases typically are comparatively complex and expensive which, while perhaps providing some added specialized features, are too cumbersome for an organized, appealing display during use. Against this background of unfilled needs, the instant invention was developed.

SUMMARY OF THE INVENTION (DISCLOSURE OF THE INVENTION)

The present invention relates to a multi-paneled organizer apparatus which is foldable to a compact size, and yet which may be unfolded in an innovative way to provide for an neat, aesthetic, and organized presentation of the contents to the user or to a customer. Broadly described, the invention provides an organizer apparatus comprising a serially arranged plurality of panels wherein adjacent panels are pivotally connected and foldable between a substantially coplanar relation and a substantially parallel relation, plus means for releasably fastening together in parallel relation at least one selected pair of adjacent panels, and means, on at least one panel of the selected pair of panels, for holding an item, where the organizer is movable between an open configuration wherein all the panels are mutually substantially co-planar and a partially closed configuration wherein the at least one selected pair of adjacent panels are fastened in parallel and pivotal together in relation to another of the panels.

Also according to the invention, there is provided an organizer apparatus comprised of a sheet, having a cover face and an inside face, which is substantially equally divided by a plurality of parallel plications into at least six panels. The panels are a first and second center panels mutually adjacent along a central one of the plications, a first intermediate panel adjacent the first center panel, a second intermediate panel adjacent the second center panel, a first end panel and a second end panel with each of the at least six panels comprising an inner side. The invention also has fasteners on the cover face of the sheet for releasably fastening the first intermediate panel to the first center panel, and fasteners on the cover face for releasably fastening the second center panel to the second intermediate panel. The sheet is foldable at the plications to place the at least six panels in mutually parallel relation with the first intermediate panel in contact with the first center panel, and with the second center panel in contact with the second intermediate panel. Preferably, the sheet comprises at least two flexible plies and the plications comprise living hinges. In the preferred embodiment, at least one of the at least six panels comprises a substantially planar rigid core disposed between the at least two flexible plies, and also at least one of the at least six panels, other than the panel comprising a rigid core, preferably comprises a substantially flexible panel. The apparatus also further comprises means, on the inner side of the flexible panel, for holding at least one non-planar item. Additionally, the apparatus may have closure means for releasably connecting the second end panel to the first end panel. This closure means preferably comprises a pliant flap extending from the second end panel and disposable parallel against the first end panel when the six panels are placed in mutually parallel relation, and means for temporarily securing the pliant flap to the first end panel. In the preferred embodiment, the pliant flap has thereon a pocket means for holding disposable tissues between the flap and the first end panel when the means for temporarily securing is engaged.

More specifically, there is provided by the invention an organizer apparatus comprising: an oblong sheet substantially equally divided into six panels by five parallel plications, the panels being: first and second center panels mutually adjacent along a central one of the plications; a first intermediate panel adjacent the first center panel along a first intermediate one of the plications; a second intermediate panel adjacent the second center panel along a second intermediate one of the plications; a first end panel adjacent the first intermediate panel; and a second end panel adjacent the second intermediate panel, wherein each of the six panels comprises a cover side and an inner side; the organizer further comprising first means, on respective cover sides of the first intermediate panel and the first center panel, for releasably fastening together the cover sides of the first intermediate panel and the first center panel; second means, on respective cover sides of the second center panel and the second intermediate panel, for releasably fastening together the cover sides of the second center panel and the second intermediate panel; and closure means for releasably connecting the second end panel to the first end panel, with the closure means comprising: a pliant flap extending from the second end panel and disposable parallel against the first end panel when the at least six panels are placed in mutually parallel relation; and means for temporarily securing the pliant flap to the first end panel. In the preferred embodiment, the sheet is foldable at the central and the first intermediate plications to place the first center and the first intermediate panels in mutually parallel relation whereby to engage the first fastening means, and wherein the sheet is foldable at the central and the second intermediate plication to place the second center and the second intermediate panels in mutually parallel relation whereby to engage the second fastening means. The bifacial sheet comprises at least two flexible plies and the plications comprise living hinges. Also, at least one of the six panels preferably comprises a substantially planar rigid core disposed between the at least two flexible plies, and at least one of the six panels, other than the panel comprising a rigid core, preferably comprises a substantially flexible panel. The apparatus of the invention also preferably comprises means, on the inner side of the flexible panel, for holding at least one nonplanar item.

A primary object of the present invention is to provide an organizer apparatus which is simple yet versatile, without being bulky.

Another object of the invention is to provide an organizer apparatus which is well-suited for displaying samples, such as samples and exemplars of cosmetics products, during sales presentations and demonstrations.

A primary advantage of the present invention is that the invention permits many items to be carried in a secure and organized manner, but which any particular item to be located and retrieved quickly.

Another advantage of the invention is that the invention may hold and display both planar and non-planar items, and yet may be foldably collapsed into a compact configuration for carriage in the hands or in a case or tote bag.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

(BEST MODES FOR CARRYING OUT THE INVENTION)

Figure 1:
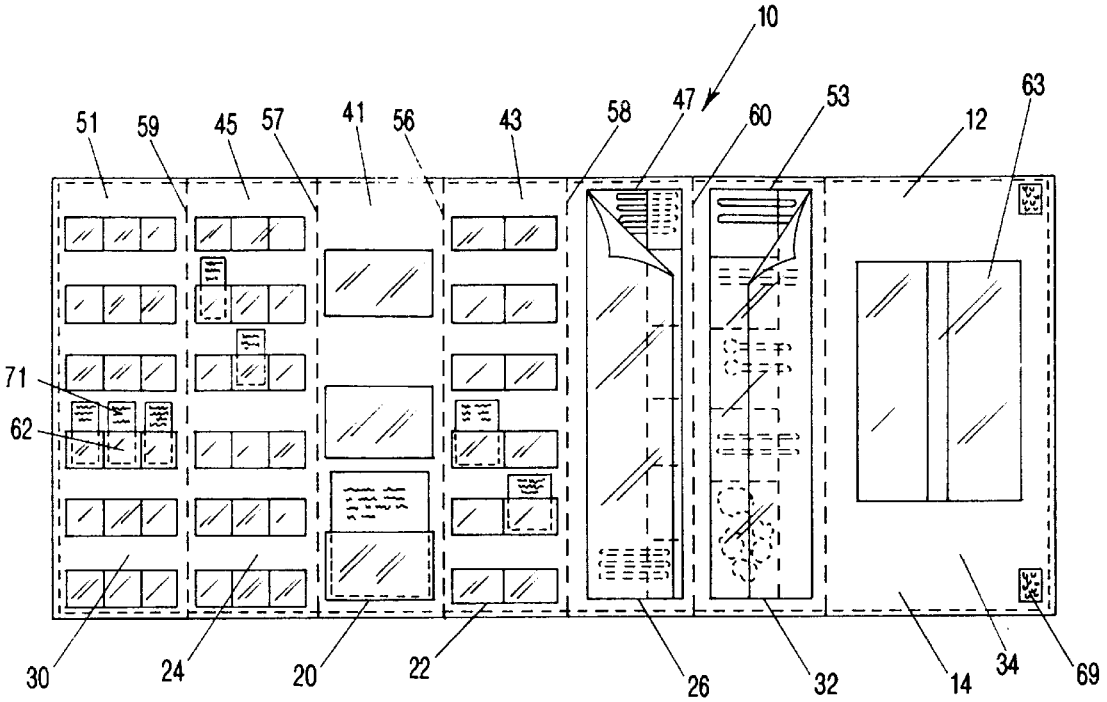
FIG. 1 is a plan view of the inside face of a preferred embodiment of the apparatus, fully extended.

The invention relates to a useful and novel organizer for carrying an assortment of any of a wide variety of items. The apparatus of the invention is generally in the manner of pocketbooks and portfolios in that it is adapted to be easily carried and manipulated in one or two hands. The apparatus is intended for use in organizing and carrying a large number of small items, and to permit the user to present the carried items in an orderly and fluent way. For instance, the invention will find immediate utility by salespeople. A salesperson may use the invention to organize numerous samples for aesthetic and efficient presentation to customers. One intended use of the invention is for the organization, carriage, and presentation of cosmetics samples. Specifically, the cosmetics salesperson can use the invention to demonstrate products in the course of performing promotional facials or classes. The organizer invention is particularly well-suited for holding and displaying samples of eye shadows, blushes, lipsticks and pencils, as well as cosmetics applicators and brushes. The device nevertheless can be collapsed to a compact size, while maintaining the organization of its contents, for placement into a small carrying case or tote bag.

Very broadly described, the inventive organizer includes a single sheet or lamina which is divided, by folds or plications, into at least six panels. Alternative embodiments may have more than six panels, but it has been determined that six panels optimize the ease of use while still providing adequate storage and organization. The sheet has a cover face and an inner face, with a variety of pockets, loops, and other means for holding items disposed on the inner face. The sheet is foldable, along the plications between the panels, in an innovative manner which promotes the display and demonstration utilities of the invention without compromising the convenience, security, or organizational advantages.

Combined reference is made to FIGS. 1–4. The organizer 10 includes, in one preferred embodiment, an oblong sheet 12 which is substantially equally divided into six panels 20, 22, 24, 26, 30 and 32 by five parallel fold lines or plications 56, 57, 58, 59, and 60. The sheet 12 preferably is made from pliable, durable, washable material such as vinyl, although alternatively could be fashioned from cardboard, leather, plastic, cloth, or the like. The sheet 12 is bifacial, having a cover face 13 and an inside face 14. In the preferred embodiment, the sheet 12 is of multi-ply construction, such as two substantially coextensive plies of vinyl sealed or stitched together. The plications 56, 57, 58, 59, and 60 accordingly preferably comprise "living hinges" whereby the various panels 20, 22, 24, 26, 30 and 32 are linked at folds or creases in the layers comprising the sheet 12. Alternatively but less desirably, the plications 56, 57, 58, 59, and 60 may be some other type of hinged connection which permits the panels 20, 22, 24, 26, 30 and 32 freely to pivot and fold in relation to one another.

For purposes of description, the panels are referred to as the first and second center panels 20 and 22, respectively, which are mutually adjacent along the central plication 56; the first intermediate panel 24 adjacent the first center panel 20 along a first intermediate plication 57; a second intermediate panel 26 adjacent the second center panel 22 along the second intermediate plication 58; the first end panel 30 adjacent, along the outside plication 59, to the first intermediate panel 24; and the second end panel 32 which is adjacent, along the outside plication 60, to the second intermediate panel 26. As indicated in the figures, each one of the panels 20, 22, 24, 26, 30 and 32 has a cover side and an inner side. First center panel 20 has its cover and inner sides 40, 41, respectively. Second center panel features cover side 42 and inner side 43. The first intermediate panel 24 has a cover side 44 opposite its inner side 45, while the cover side 46 of the second intermediate panel 26 is opposite its inner side 47. The first end panel 30 and the second end panel 32 have their respective cover sides 50, 52 and inner sides 51, 53 in like fashion.

Figure 3:
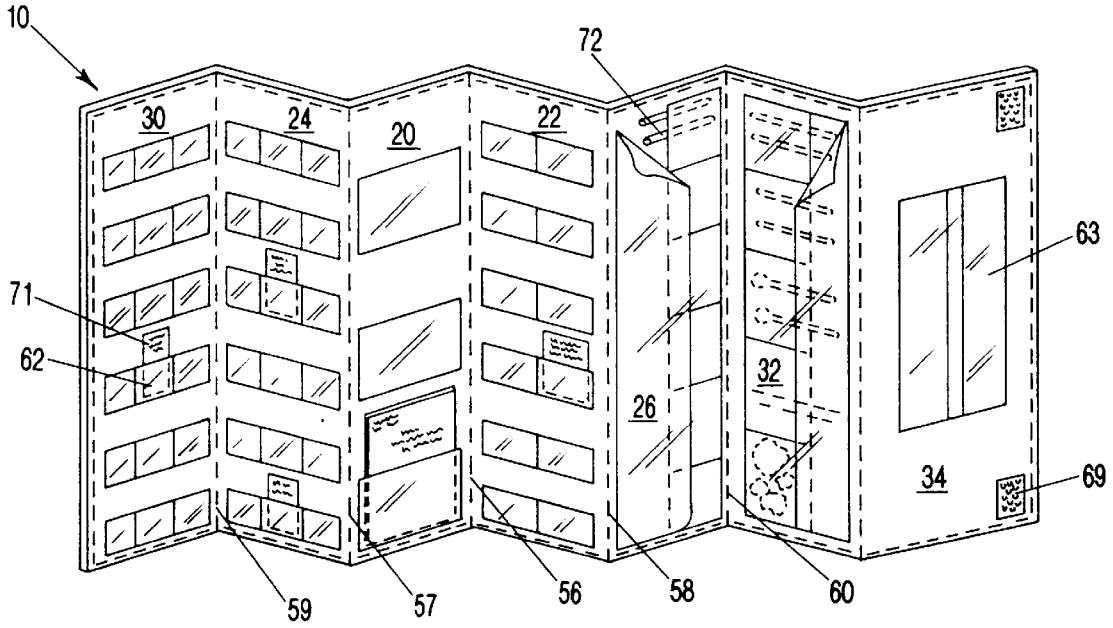
FIG. 3 is a perspective view of the inside face of the embodiment shown in FIG. 1, partially collapsed.
Figure 5:
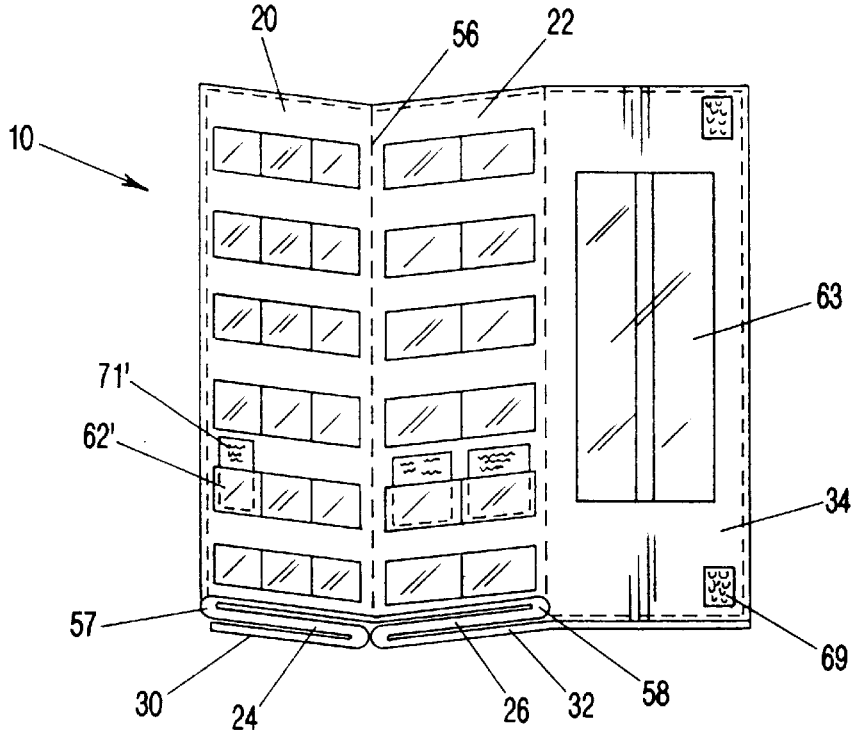
FIG. 5 is a perspective view of the embodiment shown in FIG. 3, in a mostly collapsed position.

As illustrated in FIGS. 1, 3, and 5, the inner sides 41, 43, 45, 47, 51, and 53 of the various panels mount a variety of pocket holders 62, 62' and other like elements for receiving and holding various items 71, 71' for organization and display. In the preferred embodiment, the pockets 62 are fashioned from medium gage transparent vinyl, heat or chemically bonded to the inside face 14 of the sheet 12. The pocket holders 62, 62' may be of a uniform size across all the panels 20, 22, 24, 26, 30 and 32, or may as well vary in size, with sizes customized to accommodate specialized uses. Pockets 62, 62' also may be solid, clear, opaque, removable, or feature removable liner elements (not shown) as known to the art.

One advantage of the invention is that planar 71 and non-planar 72 items may be stowed and displayed. Planar items 71 are items which are substantially flat with only two significant dimensions and one very thin minor dimension, and include, for example small sample cards and disks, coins and tokens, or the like. Non-planar items 72 have substantial thickness with significant size in three dimensions. An example of a non-planar item is the color pencil 72 seen in FIG. 3. Importantly, planar items are readily stored in vinyl or other clear plastic pockets 62, 62' because little or no stretching of the vinyl material is required to insert an item into the pocket. Vinyl pockets are not easily stretched to accommodate a non-planar item, especially if, as known in the art, all panel elements are substantially inflexible due to the presence in the panels of cardboard or other rigidifying structural material. Nevertheless, some type of rigid core is desirable in portfolio type organizers in order to lend structural integrity to the apparatus.

Figure 7:
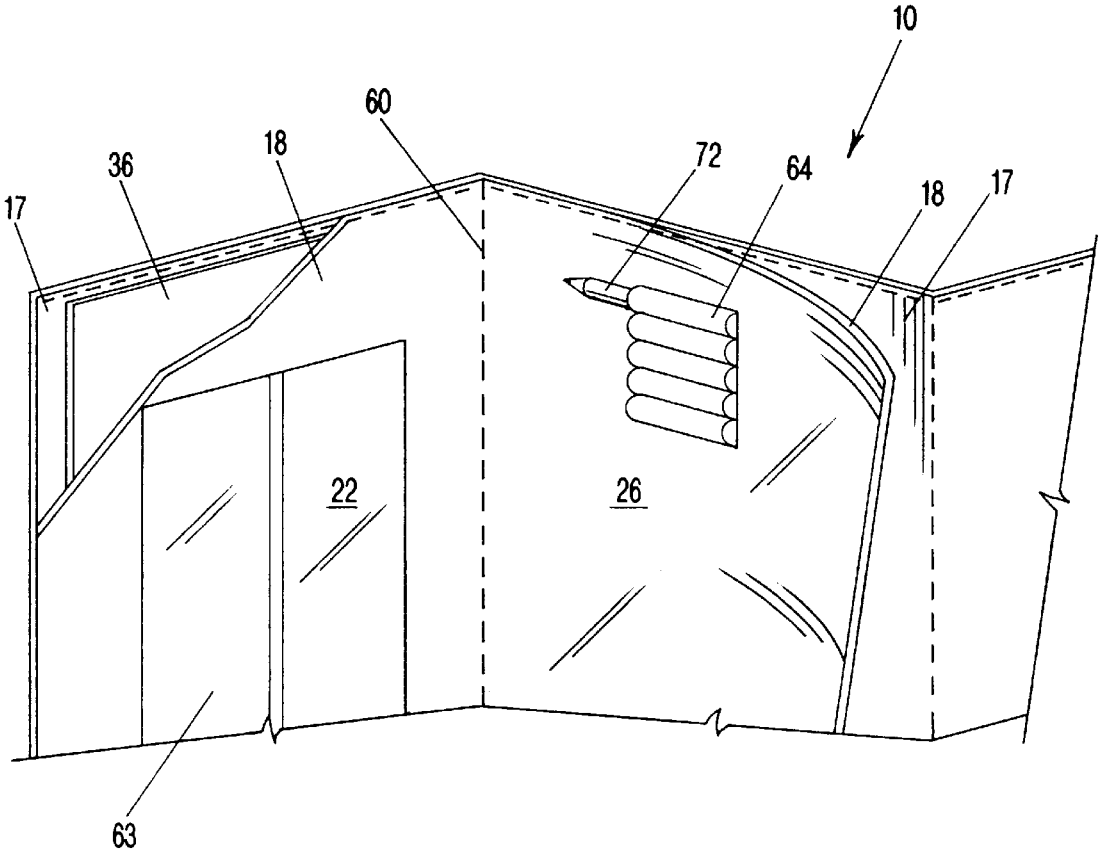
FIG. 7 is an enlarged perspective view of part of the embodiment shown in FIG. 3, with portions broken and peeled away to reveal inner elements.

The present invention meets the described competing needs for structural integrity and pocket flexibility by providing panels of selected construction. Attention is invited to FIG. 7, which shows one preferred mode of constructing the organizer 10. FIG. 7 is an enlarged view of the top segment of, for instance, the outside plication 60 and the adjacent inner sides of the second center panel 22 and the second intermediate panel 26. In the preferred embodiment, five of the six panels 20, 22, 24, 26, 30 and 32 are constructed generally in the manner shown for rigidly connected panel 22 in FIG. 7. In the case of these rigidly constructed panels, a comparatively stiff planar core 36 is disposed between the flexible outside or cover ply 17 and the flexible inside ply 18 of the sheet 12. Thus, outside ply 17 may correspond to the cover face 13 of the sheet 12 and be made of vinyl or the like; similarly, the inside ply 18 typically is made of flexible vinyl, or cloth, or leather. The core 36 sandwiched therebetween has dimensions generally corresponding to the dimensions of the panel 22, and may be made from a stiff leaf of plastic, cardboard, or the like, which imparts structural rigidity to the panel and resists bending.

Continuing reference to FIG. 7 shows that at least one of the panels 20, 22, 24, 26, 30 or 32, in the illustration the second intermediate panel 26, lacks a rigid core, and thus is a flexible panel. The flexible panel 26 is fashioned from the two plies 17, 18 of the sheet 12. With the rigid core omitted, the flexible panel serves the special function of permitting the storage and display of non-planar objects. As seen in FIG. 7, the non-flexible panel 26 preferably is the panel which may mount loops 64, gussetted pockets, clips or the like which may be used to hold nonplanar objects such as a pencil 72, or brush, or the like. Because the flexible panel 26 lacks a rigid core, the flexibility of the plies 17, 18 permits the panel 26 to yield somewhat when a non-planar object is inserted into the loop 64. A combination of a modest amount of stretching of the loop 64 and the "give" of the panel 26 allows for non-planar objects to be stored and displayed in the organizer. Significantly, however, one or more of the other panels, e.g. 22, are provided with the rigid core 36. When the organizer 10 is collapsed to the position shown in FIG. 6, the rigid cores in the other panels provide structural integrity and overall rigidity to the organizer 10 while yet permitting the storage of the non-planar elements 72. In the most preferred embodiment of the organizer 10 only one panel (e.g. an intermediate panel 26) is flexible, while the remaining panels all feature rigidifying cores 36. Thus, one panel 26 flexes to receive thereon non-planar items, while all the other panels provide structural rigidity to the organizer 10 when it is in use.

Figure 6:
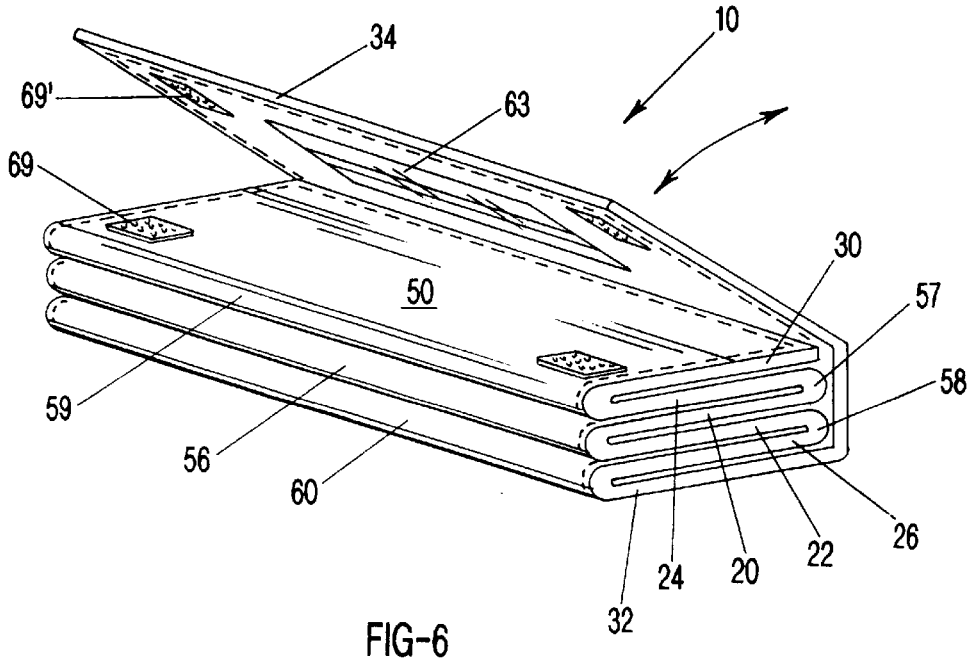
FIG. 6 is a perspective view of the embodiment of FIG. 5 in a nearly completely collapsed position.

An advantage of the organizer 10 is its ability to be foldably collapsed into the compact configuration shown in FIG. 6, without jeopardizing the security or organization of the contents. To this end, fasteners are specially located at key places upon the cover face 13 of the sheet 12, as most clearly shown in FIGS. 2 and 4. On respective cover sides 44 and 40 of the first intermediate panel 24 and the first center panel 20 are disposed at least one set of fasteners 65', 65 for releasably fastening together the cover sides 40, 44. Fasteners 65, 65' may be complementary hook-and-loop fabric fasteners (e.g. VELCRO® fasteners or the like). Alternatively, the fasteners may be ball-and-socket type "snap" fasteners, or any other like fastening device which permits the two planar surfaces of the cover sides 40, 44 to be fastened temporarily together. Hook-and-loop fasteners are preferred, as illustrated in the drawings, due to their convenient and familiar manner of engagement and disengagement.

Figure 2:
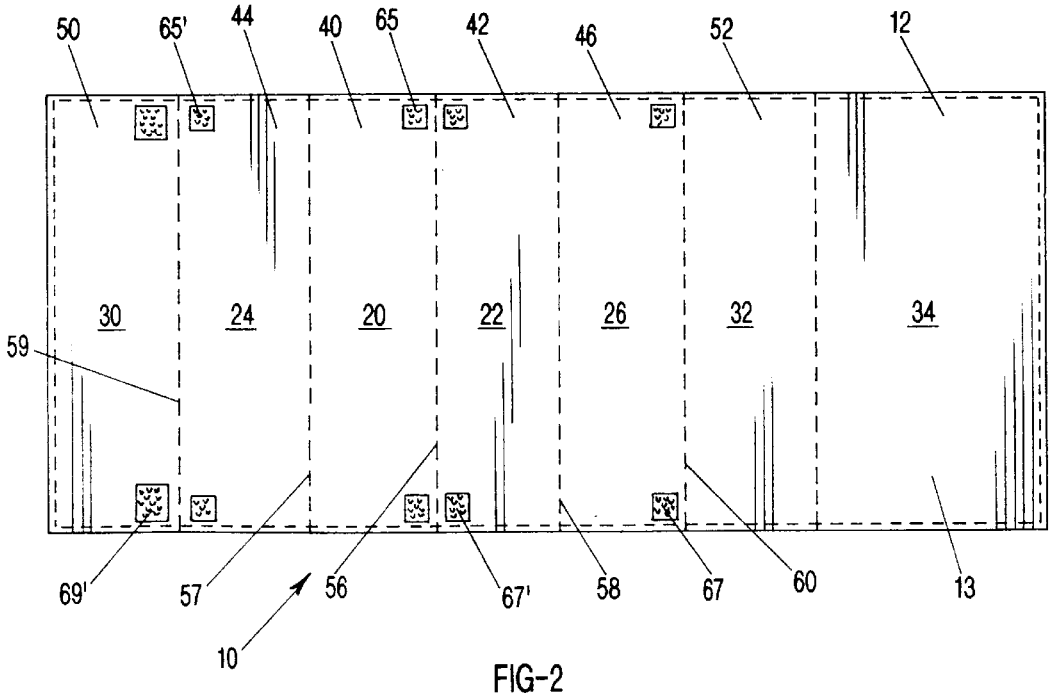
FIG. 2 is a plan view of the cover face of the embodiment shown in FIG. 1.
Figure 4:
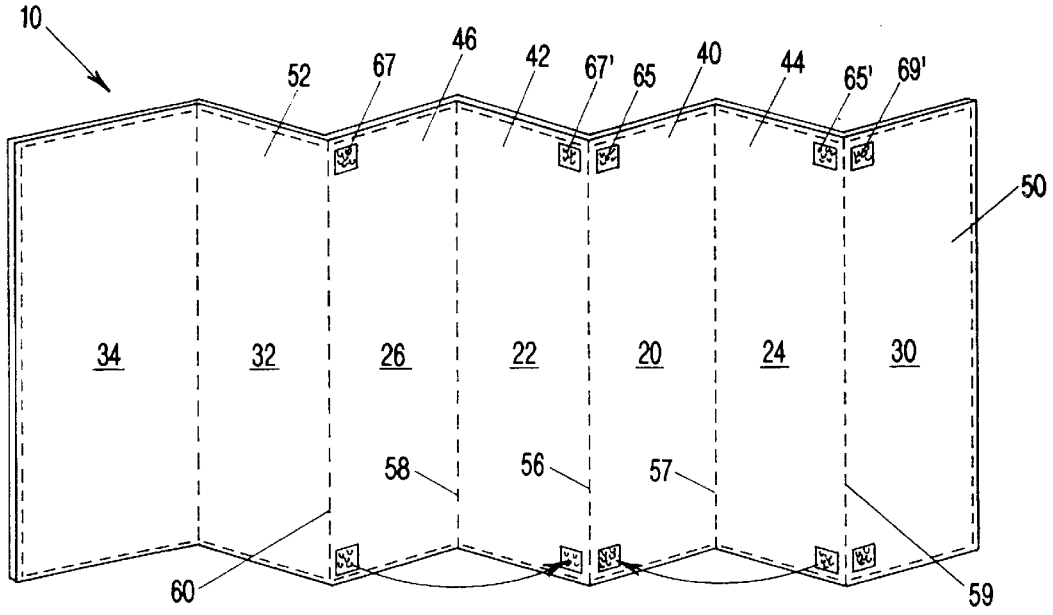
FIG. 4 is a perspective view of the cover face of the embodiment shown in FIG. 3.

Similarly, a second pair of complementary fasteners 67', 67, on respective cover sides 42, 46 of the second center panel 22 and the second intermediate panel 26, are provided for releasably fastening together the cover sides 42, 46. Again, as explained, hook-and-loop fasteners 67, 67' are preferred, due to their convenient and familiar manner of engagement and dis-engagement. As illustrated in FIGS. 2 and 4, fasteners preferably are disposed at both the top and bottom edges of the panels, although only two pairs of complementary fasteners 65, 65' and 67, 67' are specifically labeled. Alternative embodiments, of course, may utilize different quantities of fasteners, or locate the fasteners in different positions upon the cover sides 40, 42, 44, 46 without departing from the spirit of the invention.

Combined reference is made to FIGS. 3, 4, and 6. When the organizer 10 is folded to be in the completely collapsed position, the invention preferably includes a closure for releasably connecting the second end panel 32 to the first end panel 30. This closure preferably is a pliant flap 34 extending from the second end panel 32 and which is disposable parallel against the first end panel 30 when the panels are placed in mutually parallel relation as seen in FIG. 6. The pliant flap 34 may be temporarily secured to the first end panel 30 by the use of complementary fasteners 69, 69' which may be hook-and-loop or snap fasteners disposed upon the inner side of the flap 34 and the cover side 50 of the first end panel 30.

Notably, when the panels 20, 22, 24, 26, 30 and 32 are placed in mutually parallel relation as seen in FIG. 6, the pliant flap 34, extending from the second end panel 32, may be wrapped along the side of the stack of panels and laid flush against the cover side 50 to engage the fasteners 69, 69' to secure the entire stack into a single, easily managed bundle. Notably, the proper stacking of the panels 20, 22, 24, 26, 30 and 32, where the sheet 12 is folded at the plications 56, 57, 58, 59, and 60 to place the panels in mutually parallel relation, results in the cover side 44 of the first intermediate panel 24 in contact with the cover side 40 of the first center panel 20 and with the cover side 42 of the second center panel 22 in contact with the cover side 46 of the second intermediate panel 26. Indeed, a distinct advantage of the organizer 10 is its mode of folding collapse to the compact configuration for stowage and carriage. As indicated by the directional arrows in FIG. 4, the sheet 10 is foldable at the central plication 56 and the first intermediate plication 57 to place the first center and the first intermediate panels 20, 24 in mutually parallel relation to engage the fasteners 65, 65'. Likewise, the sheet 10 also is foldable at the central plication 56 and the second intermediate plication 58 to place the second center and the second intermediate panels 22, 26 in mutually parallel relation to engage the second set of fasteners 67, 67'.

The closure flap 34, similarly to the panels 20, 22, 24, 26, 30 and 32, optionally may mount any of various pocket holders on its inner side. Reference to FIGS. 1, 3, 5, and 6 shows that in the preferred embodiment, the inner side of the pliant closure flap 34 features a holder 63 customized for holding disposable tissues between the flap 34 and the cover face 50 of the first end panel 30 when the fasteners 69, 69' are temporarily engaged. The tissue holder 63 preferably comprises a transparent vinyl or cloth pocket, with a slit to permit insertion of a bundle of tissues and one-by-one extraction of tissues for use. Disposable paper tissues are particularly useful when the organizer 10 is used as a cosmetics carrier and display. Alternatively, the tissue holder 63 may be disposed upon any one of the panels, such as second central panel 22 seen in FIG. 7.

The described manner of folding and unfolding the organizer 10 promotes its attractive and facile use as a sales demonstrator. As previously described, the organizer 10 properly is collapsed by folding it at the plications 56, 57, 58, 59, and 60, in an accordion-like, or pleated "zig-zag" manner, to place the panels in mutually parallel relation with the first intermediate panel 24 in contact with the first center panel 20, and with the second center panel 22 in contact with the second intermediate panel 26 thereby to engage the various fasteners 65, 65', 67, 67', respectively situated therebetween.

As best illustrated by FIG. 5, the organizer may be only partially closed or collapsed, to permit it to be used in a book-like configuration. In this regard, it is seen that the serially arranged plurality of panels 20, 22, 24, 26, 30 and 32, wherein adjacent panels are pivotally connected and foldable about the plications 56, 57, 58, 59, and 60 between a substantially coplanar relation (e.g. FIGS. 1 and 2) and a substantially parallel relation (e.g. FIGS. 5 and 6). Included are releasable fasteners, such as fasteners 65, 65' or 67, 67', for fastening together in parallel relation at least one selected pair of adjacent panels, such as either of the center panels 20 or 22 and its adjacent intermediate panel 24, 26. When the organizer is used in the partially closed configuration seen in FIG. 5, holder means, such as pocket 62', are visible on at least one panel 20 (or 22) of the selected pair of panels, for holding an item 71'. Thus, the organizer 10 is movable between the open configuration of FIG. 1 wherein all the panels 20, 22, 24, 26, 30 and 32 are mutually substantially co-planar, and the partially closed configuration of FIG. 5 wherein at least one selected pair of adjacent panels, e.g. 22 and 26, and/or 20 and 24, are fastened in parallel and are pivotal together in relation to another of the panels, such as either of the end panels 30, 32.

The organizer 10 seen in FIG. 5 has the flap 34 fully open, the first center panel 20 fastened to the first intermediate panel 24, and the second intermediate panel 26 fastened to the second center panel 22. The flap 34, the first end panel 30 and the second end panel 32 may be placed on a table or some other supporting surface, while the center and intermediate panels 20, 22, 24, 26 may be pivoted around the center plication 56. So pivoted, the center and intermediate panels 20, 22, 24, 26 function similarly to the pages of a book, with the center plication 56 acting as a sort of "spine," thus permitting the user to turn the "pages" to and fro alternately to display the two opposing sides (i.e. the respective inner sides 41, 43, 45, 47 of the center and intermediate panels). The items stored and displayed in the organizer thereby may selectively and orderly be presented to a potential customer or the user herself, without having to "open" the organizer 10 all the way to the position of FIG. 1.

Figure 8A:
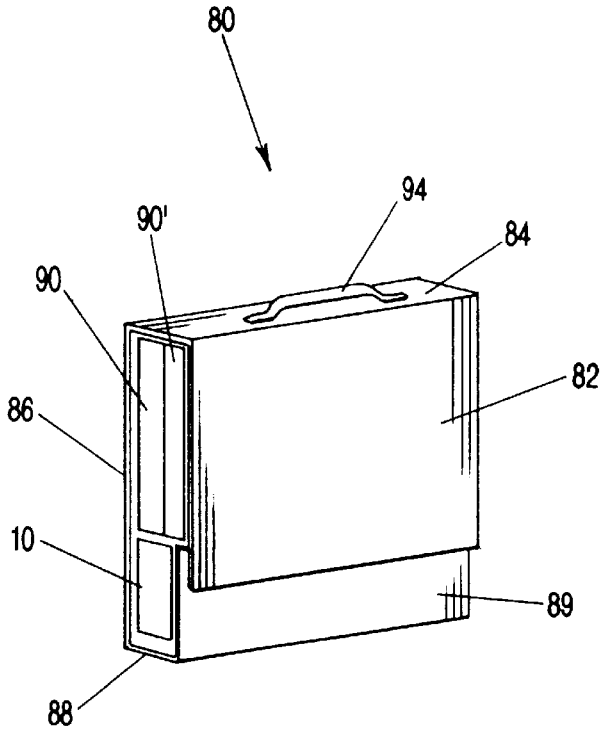
FIG. 8A is a perspective front view of a sample case in use for carrying a preferred embodiment of the organizer of the invention and other elements.
Figure 8B:
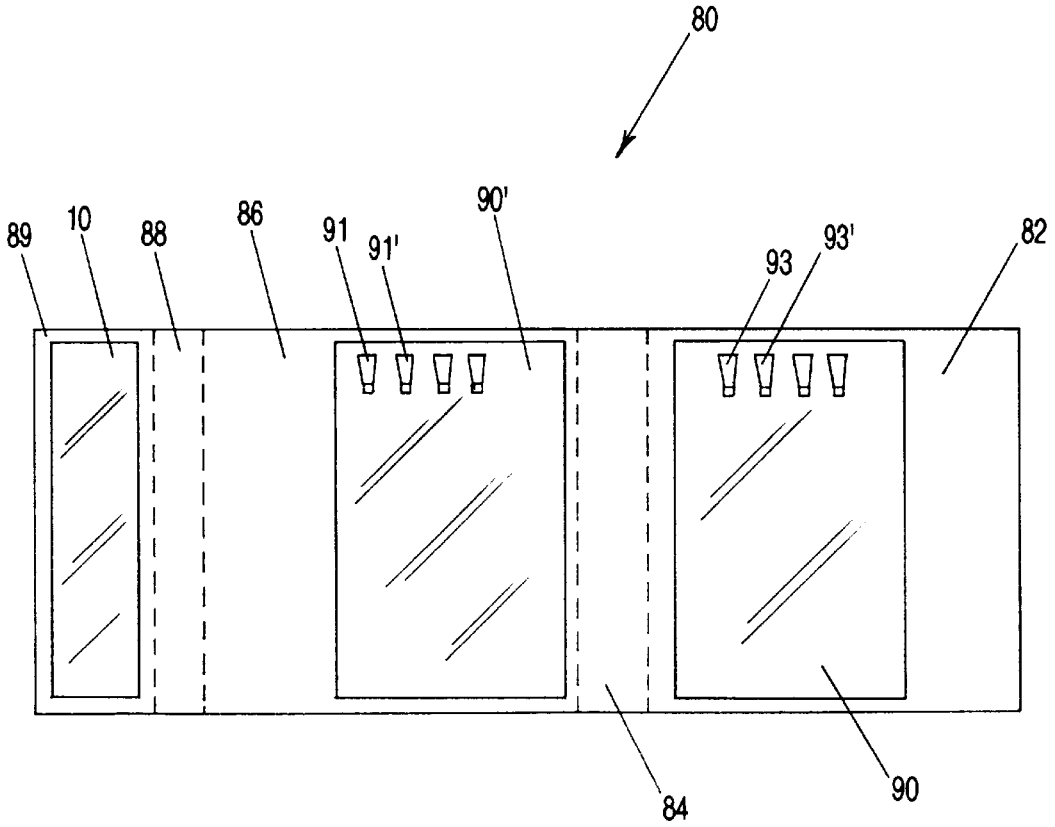
FIG. 8B is a plan view of the embodiment shown in FIG. 8A, showing the sample case in a fully open position.

There may additionally be provided various folding sample and "facial" cases specially adapted to hold and carry the organizer 10. FIGS. 8A and 8B depict one embodiment of a sample case 80 customized to hold and transport the organizer 10 in a convenient manner. The sample case 80 is made from a series of interconnected panels, which are constructed substantially similarly to the rigid panels of the organizer 10 as described herein above (i.e., multi-ply flexible vinyl layers, with the panels defined and separated by plications consisting of "living" hinges).

Referring to FIG. 8B, it is seen that the sample case 80 features a front panel 82, a top panel 84, a back panel 86, a bottom panel 88, and a return panel 89 serially interconnected by fold lines or plications. In the preferred embodiment, a pair of die-cut polyurethane, or other foam rubber, inserts 90, 90' are removably attachable to the respective interior sides of the front panel 82 and back panel 86 by means of VELCRO® fasteners or the like. The inserts 90, 90' have custom-shaped holes 91, 91', 93, 93' die-cut therethrough. Holes 91, 91', 93, 93' are shaped and adapted to receive and hold particular items, such as sample tubes of make-up, scissors, sample bottles, or other items too large to be accommodated inside the collapsed organizer 10. As also seen in FIG. 8B, a closed organizer 10 is removably attachable to the interior side of the return panel 89 with VELCRO® fasteners or the like.

In use, the sample case 80 is "rolled" around its contents and the front panel 82 temporarily secured to the return panel 89, such as by snaps or buckles or other fasteners, as depicted in FIG. 8A. The front panel 82 and back panel 86 are disposed substantially parallel, with the inserts 90, 90' securely sandwiched parallel therebetween to retain their contents. The back panel 86 and the return panel 89 similarly are disposed in parallel relation with the organizer 10 cradled on the bottom panel 88 extending from panel 86 to panel 89. The organizer 10 preferably is removably attached to the return panel 89. The return panel 89 is maintained substantially parallel to the back panel by its temporary attachment to the front panel 82. The inserts 90, 90' rest above and upon the organizer 10. Also, as shown in FIG. 8A the top panel 84 extending from the front panel 82 to the back panel 86 when the sample case 80 is closed for transport, preferably is provided with a carry handle 94.

Figure 9A:
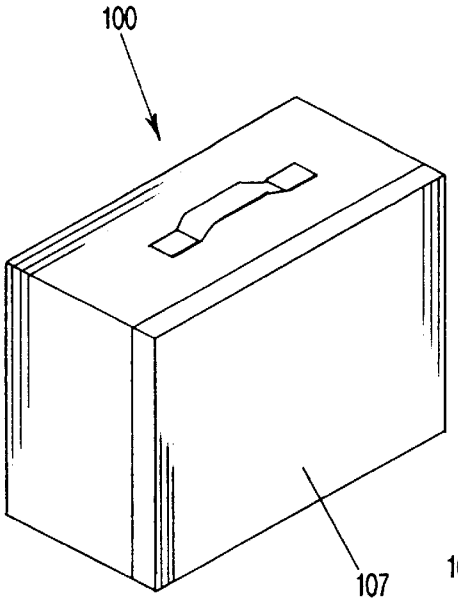
FIG. 9A is perspective front view of a facial case useable to carry one or more of the organizers in accordance with the invention.
Figure 9B:
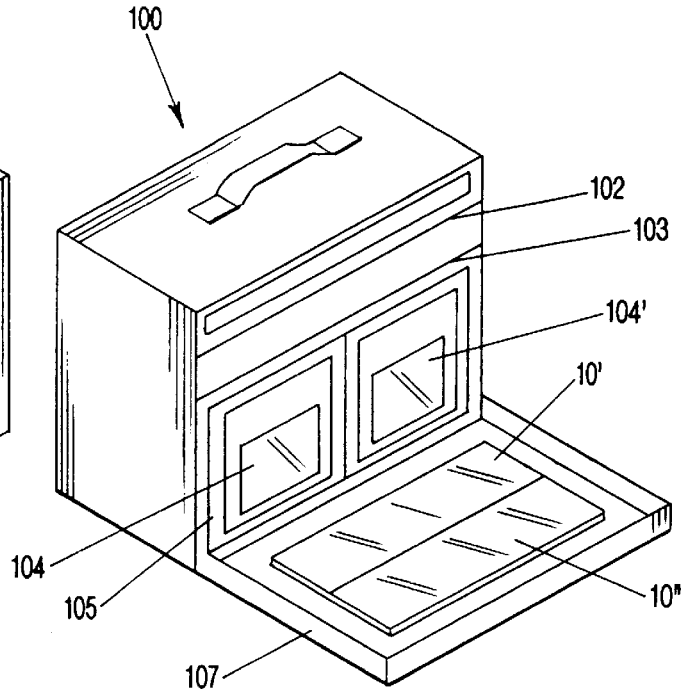
FIG. 9B is a perspective front view of the embodiment shown in FIG. 9A, showing the case in an opened position to reveal several interior features and elements.

Reference is made to FIGS. 9A and 9B. There may also be provided in accordance with the invention a facial case 100 designed to hold one or more exemplars of the organizer 10, two makeup mirrors, cosmetic demonstrator tubes and other miscellaneous items necessary to perform a "facial" cosmetics sales demonstration. The facial case 100 features recessed shelves 102, 103 that may be secured with VELCRO® fasteners or the like, and each of which is sized to hold an organizer 10 or other miscellaneous items need to perform a facial. Makeup mirrors 104, 104' are disposed in vinyl pockets on a partition 105 which is removably secured to the bottom of the case 100, along the bottom edge of partition 105. The interior space within the case 100 behind the partition 105 may be utilized to hold demonstration materials or other items, which may be held in place by vinyl loops attached to the interior walls of the case 100. Three edges of a side 107 are connected to the body of the case 100 by hook-and-loop fasteners or by a zipper or the like. The fourth, bottom edge of the side 107 is foldably attached to the bottom of the case 100 to form a living hinge to permit the side 107, when opened, to pivot out and down from the position seen in FIG. 9A to the position shown in FIG. 9B. Opening the side 107 of the case 100 permits access to one or more organizers 10', 10" removably attachable to the interior face of the side 107.

Figure 10:
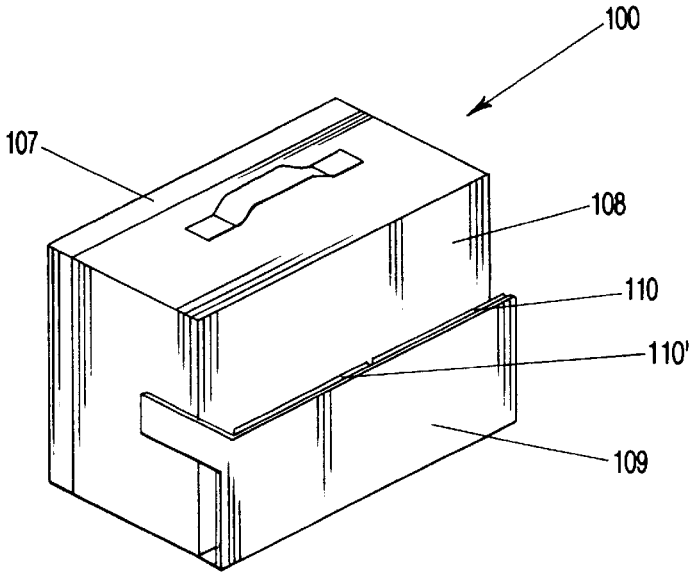
FIG. 10 is a perspective back view of the embodiment shown in FIG. 9A, illustrating the case in an alternative mode of use.

FIG. 10 illustrates that the back side 108 of the facial case 100 may also optionally be utilized to carry specialized materials. A removable vinyl panel 109 is removably attachable to the bottom and back side of the case 100, with hook-and-loop fasteners or the like, to retain in place for transportation and ready availability one or more makeup mirrors 110, 110'.

It will be apparent to those of skill in the art that while the apparatus of the invention is particularly well-suited for use in cosmetics organization and sales, the apparatus may find other desirable uses. For example, the organizer 10 may be customized to hold and/or display fishing tackle, small items of hardware, sewing tools, fabric swatches, jewelry, cassette tapes, compact disks, stamps and philatelic supplies, coins, photographic slides, business cards, spice samples, or other planar and non-planar items.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding provisional application, are hereby incorporated by reference.

What is claimed is:

1. An organizer apparatus comprising:

a sheet, having a cover face and an inside face, and substantially equally divided by a plurality of parallel plications into multiple panels, said sheet comprising: at least two flexible plies and said plications comprise living hinges, and further wherein, when a first intermediate panel and a first center panel are fastened to form a first fastened pair, said first fastened pair pivots in relation to all other said multiple panels, and also wherein, when a second center panel and a second intermediate panel are fastened to form a second fastened pair, said second fastened pair pivots together in relation to all other said multiple panels, and finally wherein at least two of said multiple panels maintain a coplanar position on opposite sides adjacent to the combination of said first and second fastened pairs; and said panels comprising:

said first and second center panels mutually adjacent along a central one of said plications;

said first intermediate panel adjacent said first center panel;

said second intermediate panel adjacent said second center panel;

a first end panel; and a second end panel;

wherein each of said multiple panels comprises an inner side, and at least one of said multiple panels comprises a substantially planar rigid core disposed between said at least two flexible plies and at least one of said multiple panels, other than said panel comprising a substantially planar rigid core, comprises a substantially flexible panel;

means on said cover face for releasably fastening said first intermediate panel to said first center panel; and means on said cover face for releasably fastening said second center panel to said second intermediate panel;

wherein said sheet is foldable at said plications to place said multiple panels in mutually parallel relation with said first intermediate panel in contact with said first center panel, and with said second center panel in contact with said second intermediate panel.

2. An apparatus according to claim 1 further comprising means, on said inner side of said flexible panel, for holding at least one non-planar item.

3. An apparatus according to claim 1 further comprising closure means for releasably connecting said second end panel to said first end panel.

4. An apparatus according to claim 3 wherein said closure means comprises:

a pliant flap extending from said second end panel and disposable parallel against said first end panel when said multiple panels are placed in mutually parallel relation; and means for temporarily securing said pliant flap to said first end panel.

5. An apparatus according to claim 4 further comprising means on said pliant flap for holding disposable tissues between said flap and said first end panel when said means for temporarily securing is engaged.

6. An organizer apparatus comprising:

a bifacial sheet, said sheet divided by five plications into six panels, said panels comprising:

first and second center panels mutually adjacent along a central one of said plications;

a first intermediate panel adjacent said first center panel;

a second intermediate panel adjacent said second center panel;

a first end panel adjacent said first intermediate panel; and a second end panel adjacent said second intermediate panel;

wherein each of said six panels comprises a cover side and an inner side;

means, on at least one of said inner sides, for holding at least one item;

means, on respective cover sides of said first intermediate panel and said first center panel, for releasably fastening said cover side of said first intermediate panel to said cover side of said first center panel; and means, on respective cover sides of said second center panel and said second intermediate panel, for releasably fastening said cover side of said second center panel to said cover side of said second intermediate panel;

wherein said sheet is foldable at said plications to place said six panels in mutually parallel relation with said cover side of said first intermediate panel in contact with said cover side of said first center panel and with said cover side of said second center panel in contact with said cover side of said second intermediate panel.

7. An organizer according to claim 6 further comprising closure means for releasably connecting said second end panel to said first end panel.

8. An organizer according to claim 7 wherein said closure means comprises:

a pliant flap extending from said second end panel and disposable parallel against said first end panel when said six panels are placed in mutually parallel relation; and means for temporarily securing said pliant flap to said cover side of said first end panel.

9. An apparatus according to claim 8 wherein said bifacial sheet comprises at least two flexible plies and said plications comprise living hinges.

10. An apparatus according to claim 9 wherein at least one of said six panels comprises a substantially planar rigid core disposed between said at least two flexible plies.

11. An apparatus according to claim 10 wherein at least one of said six panels, other than said panel comprising a substantially planar rigid core, comprises a substantially flexible panel.

12. An apparatus according to claim 11 further comprising means, on said inner side of said flexible panel, for holding at least one non-planar item.

13. An organizer apparatus comprising:

an oblong sheet substantially equally divided into six panels by five parallel plications, said panels comprising:

first and second center panels mutually adjacent along a central one of said plications;

a first intermediate panel adjacent said first center panel along a first intermediate one of said plications;

a second intermediate panel adjacent said second center panel along a second intermediate one of said plications;

a first end panel adjacent said first intermediate panel; and a second end panel adjacent said second intermediate panel;

wherein each of said six panels comprises a cover side and an inner side;

first means, on respective cover sides of said first intermediate panel and said first center panel, for releasably fastening together said cover sides of said first intermediate panel and said first center panel;

second means, on respective cover sides of said second center panel and said second intermediate panel, for releasably fastening together said cover sides of said second center panel and said second intermediate panel; and closure means for releasably connecting said second end panel to said first end panel, said closure means comprising:

a pliant flap extending from said second end panel and disposable parallel against said first end panel when said at least six panels are placed in mutually parallel relation; and means for temporarily securing said pliant flap to said first end panel;

wherein said sheet is foldable at said central and said first intermediate plication to place said first center and said first intermediate panels in mutually parallel relation whereby to engage said first fastening means, and wherein said sheet is foldable at said central and said second intermediate plication to place said second center and said second intermediate panels in mutually parallel relation whereby to engage said second fastening means.

14. An apparatus according to claim 13 wherein said bifacial sheet comprises at least two flexible plies and said plications comprise living hinges.

15. An apparatus according to claim 14 wherein at least one of said six panels comprises a substantially planar rigid core disposed between said at least two flexible plies.

16. An apparatus according to claim 15 wherein at least one of said six panels, other than said panel comprising a substantially planar rigid core, comprises a substantially flexible panel.

17. An apparatus according to claim 16 further comprising means, on said inner side of said flexible panel, for holding at least one non-planar item.

* * * * *